US005530525A

United States Patent [19]

Tsujita et al.

[11] Patent Number: 5,530,525

[45] Date of Patent: Jun. 25, 1996

[54] IMAGE FORMING APPARATUS

[75] Inventors: Mitsuji Tsujita; Masahiko Maeda; Kazuhiro Mizude; Tomohiro Tsutano; Masao Uyama; Nariaki Tanaka; Takashi Terada; Takuji Terada, all of Osaka, Japan

[73] Assignee: Mita Industrial Co., Ltd., Osaka, Japan

[21] Appl. No.: 353,109

[22] Filed: Dec. 9, 1994

[30] Foreign Application Priority Data

Dec. 28, 1993 [JP] Japan ..... 5-349928

[51] Int. Cl.[6] ..... G03G 15/02

[52] U.S. Cl. ..... 355/219; 355/210

[58] Field of Search ..... 355/200, 210, 355/208, 219, 227, 296; 430/54, 56, 57

[56] References Cited

U.S. PATENT DOCUMENTS 4,522,904 6/1985 Kina et al. ..... 430/54
4,699,860 10/1987 Kitano ..... 430/57
4,827,306 5/1989 Tsujimoto et al. ..... 355/210 X
5,099,283 3/1992 Maruyama ..... 355/219 X
5,333,037 7/1994 Inoue et al. ..... 355/208 X

*Primary Examiner*—Sandra L. Brase
*Attorney, Agent, or Firm*—Renner, Otto, Boisselle & Sklar

[57] ABSTRACT

An image forming apparatus includes a charge removing device for removing the residual charge on a photosensitive film. The light emitted from an optical source of the charge removing device is selected from the range between the wavelengths which correspond to half of the maximum absorbance in a light absorbance characteristic of the photosensitive film. Since carrier generation does not occur by the light emitted by the charge removing device, the charging ability and the charge retaining ability of the photosensitive film are improved, and the image quality is significantly improved.

4 Claims, 8 Drawing Sheets

IMAGE FORMING APPARATUS

BACKGROUND OF THE INVENTION

1. Field of the Invention

The present invention relates to an image forming apparatus using an electrophotographic technology, and in particular to an image forming apparatus provided with a charge removing means for radiating light of a specific wavelength range to a photosensitive film located on a surface of a photosensitive member.

2. Description of the Related Art

Conventionally, image forming apparatuses using electrophotographic technologies have been actively developed for use as, for example, electrostatic copiers or printers.

Briefly referring to FIG. 6, a conventional image forming apparatus using an electrophotographic technology will be described. An image forming apparatus 1 includes a rotatable photosensitive drum 3 having a photosensitive film 2 located on a surface thereof, a main charger 4 for uniformly supplying the photosensitive film 2 with a prescribed level of electric charge, an optical device 5 for exposing the photosensitive film 2 and forming an electrostatic latent image on the photosensitive film 2, a developing device 6 for developing the electrostatic latent image formed on the photosensitive film 2 into a toner image, a transfer device 8 for transferring the toner image on the photosensitive film 2 onto a recording paper sheet 7, a cleaning device 9 provided with a cleaning blade for removing the residual toner on the photosensitive film 2, and a charge removing lamp 10 for removing the residual charge on the photosensitive film 2 and thus setting the surface potential of the photosensitive film 2 at a prescribed uniform level.

In the image forming apparatus 1 having the above-described structure, an image is formed in the following manner.

First, the main charger 4 supplies the photosensitive film 2 on the photosensitive drum 3 with a prescribed uniform charge. Next, light is radiated to the photosensitive film 2 by the optical device 5 to form an electrostatic latent image on the photosensitive film 2. Toner is supplied to the photosensitive film 2 by the developing device 6 to develop the electrostatic latent image into a toner image. The toner image on the photosensitive film 2 is transferred to the recording paper sheet 7 by the transfer device 8. After the transference, the residual toner on the photosensitive film 2 is removed by the cleaning device 9. Light is radiated on the photosensitive film 2 by the charge removing lamp 10 to remove the residual charge on the photosensitive film 2. Thus, the surface potential of the photosensitive film 2 is set at a prescribed uniform level. Thereafter, the photosensitive film 2 is charged again by the main charger 4. Such a process is repeated in accordance with the rotation of the photosensitive drum 3.

The photosensitive film 2 is formed of an inorganic or an organic material. Usable inorganic materials include, for example, Se-type materials and amorphous Si-type materials.

Recently, more and more photosensitive films are formed of an organic material due to high safety and easy processibility thereof. Photosensitive bodies formed of an organic photosensitive material are classified into multiple-layer organic photosensitive bodies and single-layer organic photosensitive bodies.

A multiple-layer photosensitive body includes a charge generating layer and a charge carrying layer which are laminated on a substrate. The charge carrying layer contains a charge carrying material. The charge carrying material may be a hole carrying material or an electron carrying material. There are various hole carrying materials which have a satisfactory carrying ability, whereas no electron carrying material having a satisfactory carrying ability has been developed. Accordingly, multiple-layer organic photosensitive bodies are mostly negatively charged. However, when a photosensitive body to be negatively charged is charged using a charger for performing discharge by way of corona discharge, ozone is generated. In order to prevent exposure of the human body to ozone and to protect the environment, an additional measure to deal with ozone is needed.

In an attempt to solve the above-described problem, single-layer organic photosensitive bodies have been developed. A single-layer organic photosensitive body contains a charge carrying medium which is formed of a binder resin containing a charge carrying material dispersed therein and further a charge generating material dispersed in the charge carrying medium. A photosensitive body to be positively charged can be easily formed of a single-layer photosensitive body containing a charge carrying material having an electron carrying ability.

FIG. 7 is an enlarged cross sectional view of an important part of the photosensitive drum 3 which is formed of a single-layer organic photosensitive body. The photosensitive drum 3 includes a substrate 3*a* formed of, for example, an aluminum tube and the photosensitive film 2 formed of a single-layer organic photosensitive body which is laminated on the substrate 3*a*. The photosensitive film 2 is formed of a charge carrying medium 2*a*, which is formed of a binder resin containing a charge carrying material dispersed therein and further a charge generation material 2*b* dispersed in the charge carrying medium. When light is radiated to and incident on the photosensitive film 2, the charge generating material 2*b* generates carrier pairs each having a hole and an electron.

When the photosensitive film 2 having such a structure is positively charged, positive charges are distributed on a surface of the photosensitive film 2. When light in accordance with an image is radiated to the photosensitive film 2 which is positively charged, the carrier pairs are generated. Among the carrier pairs, electrons generated in the photosensitive film 2 reach the surface of the photosensitive film 2 and are bound with the holes. In this manner, an electrostatic latent image is formed.

A single-layer organic photosensitive body is easier to produce than, and thus is preferable to, a multiple-layer organic photosensitive body. However, the photosensitive film 2 formed of a single-layer organic photosensitive body to be positively charged has a problem in that electrons which are generated as photocarriers by the charge generation material 2*b* tend to remain therein because the charge carrying medium 2*a* is low in the electron carrying ability. Due to such inferiority in the electron carrying ability of the charge carrying medium 2*a*, the photosensitive film 2 still retains a generally high charge even after being exposed to light by the charge removing lamp 10. If the photosensitive film 2 is positively charged in the state of having electrons therein, the electrons move to the surface of the photosensitive film 2 and are bound with the holes which are charged on the surface of the photosensitive film 2. As a result, the surface potential of the photosensitive film 2 is reduced, and thus the following inconveniences occur.

FIG. 8 is a graph illustrating the potential which is obtained when the process of charging-developing-removal of the charge is repeated with no exposure. The potential at the time of developing is indicated by symbol SP, and the potential immediately after the removal of the charge is indicated by symbol RP. As is appreciated from FIG. 8, when removal of the charge is insufficient, the charging potential is also insufficient. The potential SP at the time of developing reduces cycle by cycle, and the potential RP after the removal of the charge rises cycle by cycle. Accordingly, in the case that an image is to be formed by multiple rotations of the photosensitive drum 3 having the photosensitive film 2 with a relatively large amount of residual electrons as photocarriers, the density of the image changes rotation by rotation of the photosensitive drum 3, thus causing non-uniformity in the image density. Furthermore, such a large amount of electrons residual in the photosensitive film 2 reduces the surface potential at the time of developing. Especially when the main charger 4 is Scorotron, the photosensitive film 2 is charged so as to have a uniform surface potential. Accordingly, if the surface potential is reduced by the residual electrons at the time of charging, the main charger 4 performs discharge so as to compensate for the reduction in the surface potential. This increases the power consumption by the main charger 4.

SUMMARY OF THE INVENTION

An image forming apparatus according to the present invention includes a rotatable photosensitive member including a conductive substrate and a photosensitive film located on a surface of the substrate; a charging device located in the vicinity of the photosensitive member for charging the photosensitive film; an exposure device for radiating light corresponding to an image to the photosensitive film which is charged; a developing device located downstream with respect to the exposure device in a rotation direction of the photosensitive member for developing the image on the photosensitive film; a transfer device located downstream with respect to the developing device in the rotation direction of the photosensitive member for transferring the image developed on the photosensitive film onto an image receiving member; a cleaning device located downstream with respect to the transfer device in the rotation direction of the photosensitive member for cleaning the photosensitive film after the transference; and a charge removing member including an optical source located opposed to the photosensitive member for radiating light to the photosensitive film. The wavelength of light emitted by the optical source is selected from the range between wavelengths which correspond to half of a maximum absorbance in a light absorbance characteristic of the photosensitive film and a charge generation material included in the photosensitive film.

In one embodiment of the invention, the charge removing member includes at least one of a charge removing lamp located upstream with respect to the charging device in the rotation direction of the photosensitive member and in the vicinity of the cleaning device for radiating light to the photosensitive film prior to charging performed by the charging device to remove carriers residual on the photosensitive film; a blank lamp located between the charging device and the developing device for radiating light to a part of the photosensitive film; a pre-transference removing device located between the developing device and the transfer device for removing the charge of the photosensitive film prior to the transference; and a pre-cleaning removing device located between the transfer device and the cleaning device for removing the charge of the photosensitive film prior to the cleaning.

In one embodiment of the invention, the light emitted by the optical source is single color light.

In one embodiment of the invention, the photosensitive film is a single-layer organic photosensitive film to be positively charged.

According to the present invention, light having a wavelength within a range suitable to a material of the photosensitive film is radiated to the photosensitive film by the charge removing member. Therefore, generation of carriers in the photosensitive film is prevented, and thus significantly improves the image quality. Furthermore, because of the use of light of a specific wavelength, residual charge on the photosensitive film is eliminated before the photosensitive film is charged by the main charger. As a result, reduction in the surface potential can be avoided, and thus charging ability and the charge retaining ability of the photosensitive film are enhanced. Therefore, the image quality is remarkably improved. Since the use of such light also restricts generation of a heat wave, the cooling member of the image forming apparatus is simplified. Due to the restriction of the heat wave, the photosensitive film is prevented from wearing due to light and thus has stable characteristics. Furthermore, since the surface potential of the photosensitive film is maintained sufficiently well by the use of light suitable to the photosensitive film, stable aging characteristic is obtained.

Thus, the invention described herein makes possible the advantages of providing an image forming apparatus which has a photosensitive body enjoying stable characteristics, has stable aging characteristics, and realizes image formation of improved quality with a simplified structure.

These and other advantages of the present invention will become apparent to those skilled in the art upon reading and understanding the following detailed description with reference to the accompanying figures.

DESCRIPTION OF THE PREFERRED EMBODIMENTS

An image forming apparatus according to the present invention includes at least one charge removing member, opposed to a photosensitive member, for radiating light to a photosensitive film located on a surface of the photosensitive member to remove carriers residual on the photosensitive film. An optical source included in the charge removing member emits light having a wavelength selected from the range between the wavelengths which correspond to half of the maximum absorbance in a light absorbance characteristic of the photosensitive film or the charge generation material contained in the photosensitive film. Preferably, the light emitted by the charge removing member is single color light.

The light having the above-described wavelength emitted by the optical source is well absorbed in the photosensitive film without reaching a bottom part of the photosensitive film. Accordingly, carrier generation in the bottom part of the photosensitive film by the light emitted by the charge removing member is prevented. Further, the removing operation eliminates the residual carriers from the photosensitive film before the photosensitive film is charged by the main charger. As a result, the following effects can be achieved.

Since there is substantially no residual carrier in the photosensitive film, the charging ability and the charge retaining ability of the photosensitive film are improved, and thus the image quality is significantly enhanced. By selecting the suitable wavelength of the light to be emitted by the charge removing member, generation of a heat wave from the optical source of the charge removing member is restricted. Accordingly, the internal temperature of the image forming apparatus, especially the surface temperature of the photosensitive film is restricted from excessively increasing. As a result, a structure for cooling the image forming apparatus can be significantly simplified. Furthermore, wearing of the photosensitive film by light is restricted. Therefore, the characteristics of the photosensitive film are stabilized. Moreover, aging of characteristics of the image forming apparatus when used for a long period of time is also stabilized.

Hereinafter, the present invention will be described by way of illustrative examples with reference to the accompanying drawings.

Figure 1:
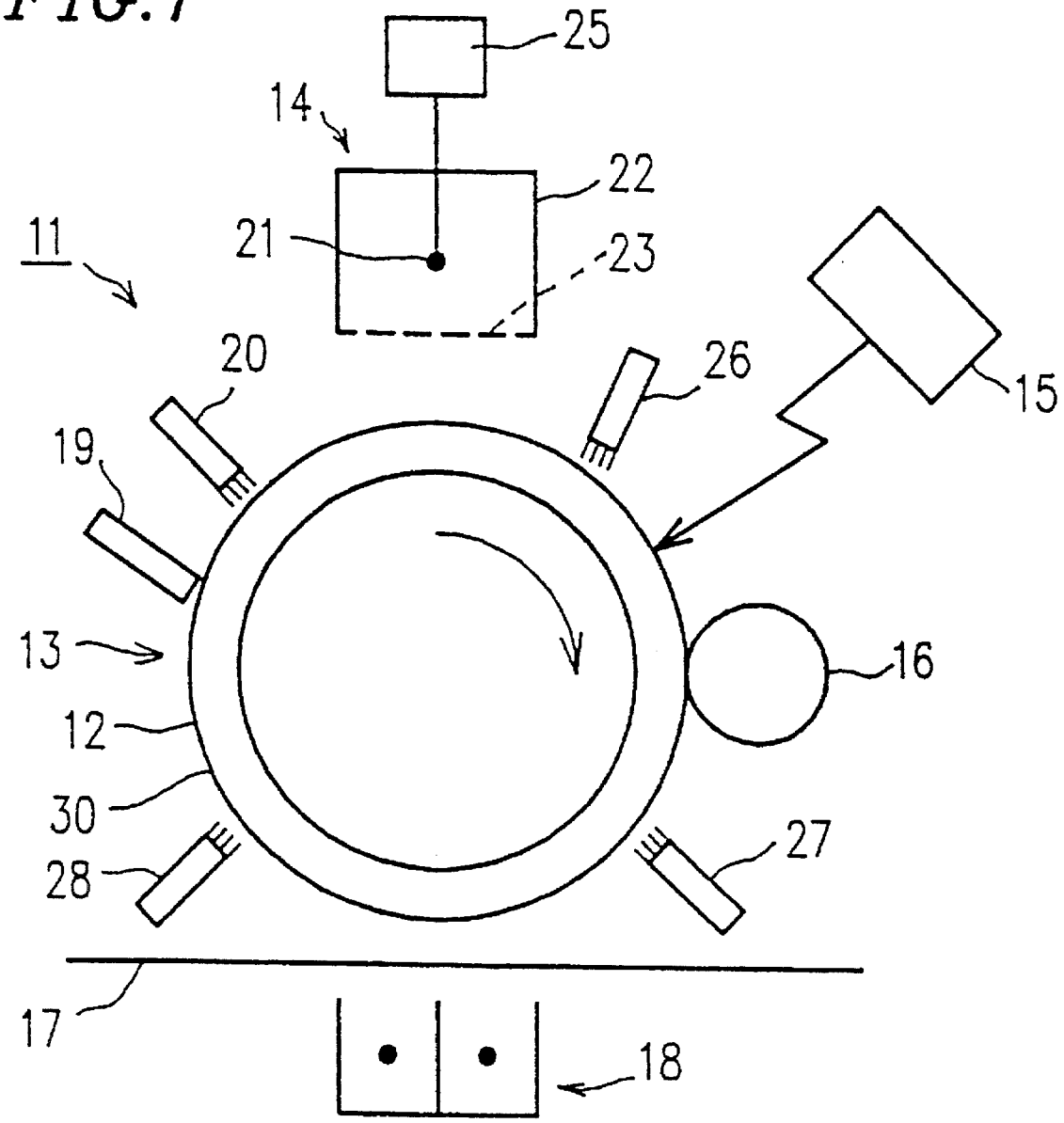
FIG. 1 is a schematic view of an image forming apparatus in an example according to the present invention.

Referring to FIG. 1, an image forming apparatus in one embodiment according to the present invention will be described. FIG. 1 is a schematic view of an image forming apparatus 11 in one example according to the present invention. The image forming apparatus 11 includes a rotatable photosensitive drum 13 acting as a photosensitive member which includes a drum substrate 30 formed of metal, for example, aluminum and a single-layer organic photosensitive film 12 located on a surface of the drum substrate 30. The photosensitive drum 13 is surrounded by a main charger 14 for uniformly supplying the photosensitive film 12 with a prescribed level of charge, an optical device 15 for exposing the photosensitive film 12 to form an electrostatic latent image on the photosensitive film 12, a developing device 16 for developing the electrostatic latent image on the photosensitive film 12 into a toner image, a transfer device 18 for transferring the toner image on the photosensitive film 12 onto, for example, a recording paper sheet 17, a cleaning device 19 for removing the residual toner on the photosensitive film 12 after the transference, and a charge removing device 20 for removing the residual charge on the photosensitive film 12.

First, the charge removing device 20 acting as a charge removing member which is a feature of the present invention will be described.

Charge Removing Device

The charge removing device 20 includes a charge removing lamp as an optical source. The optical source may be any lamp which can generate light having a prescribed wavelength. For example, an optical source for emitting visible light such as a halogen lamp, a fluorescent lamp, a cold CRT, a neon lamp for emitting light of red, green or other colors, or a tungsten lamp may be used. An optical source of single color light such as an LED (light emitting diode) for emitting light of red, yellow, green or other colors may also be used.

The wavelength of the light emitted by such an optical source of the charge removing device 20 is selected from the range between wavelengths which correspond to half of the maximum absorbance in a light absorbance characteristic of the photosensitive film 12 or the charge generating material contained in the photosensitive film 12. Preferably, the light emitted by the charge removing device 20 is single color light. The wavelength of the light emitted by the optical source is determined by the light absorbance characteristic of the photosensitive film 12. The light absorbance characteristic of the photosensitive film 12 depends on the charge carrying material, the bonding resin, the thickness of the photosensitive film 12, and especially the charge generation material. When the wavelength of the light emitted by the optical source is substantially equal to the maximum absorbance of the charge generation material, optical attenuation occurs most efficiently. The charge carrying material may have a higher light absorbance than that of the charge generation material, in which case also, the half of the maximum absorbance of the charge generation material is used to determine the suitable wavelength of the light.

A method for determining the suitable wavelength of the light used for removing the charge will be described with reference to FIG. 2.

Figure 2:
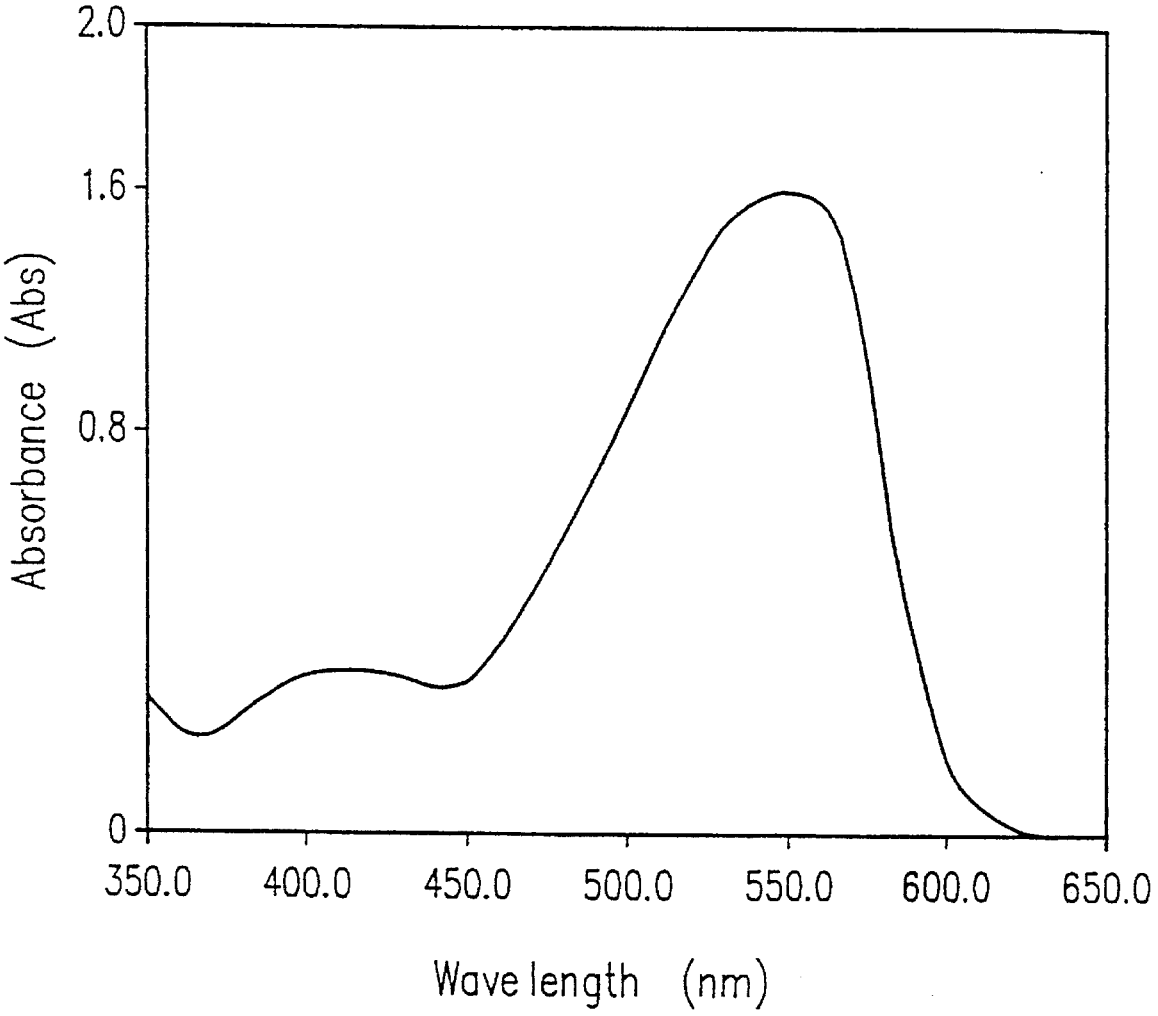
FIG. 2 is a graph illustrating the light absorbance characteristic of a photosensitive film of the image forming apparatus shown in FIG. 1.

FIG. 2 is a graph illustrating the light absorbance characteristic of the photosensitive film 12 in accordance with this embodiment. The wavelength of the light having the maximum absorbance is 550 nm, and the absolute value of the absorbance is 1.6. The light having half of the maximum absorbance, 0.8, has wavelengths of 490 nm and 583 nm. Accordingly, any type of single color light having a wavelength in the range of 490 nm to 583 nm is selected. Such single color light itself has a wavelength in a specific range, but it is not necessary that the wavelength range of the single color light is included in the range between 490 nm and 583 nm. Single color light having any wavelength within such a range may be used.

In this manner, the range of wavelengths of light to be used for the charge removing device 20 is determined based on the light absorbance characteristic of the photosensitive film 12.

In the case that an LED is used in the charge removing device 20, the one for emitting light which has a wavelength corresponding to the maximum absorbance of the photosensitive film 12 and the vicinity thereof is preferable. Accordingly, an LED for light of red, yellow, green or any other color may be selected based on the light absorbance characteristic of the photosensitive film 12.

In a preferred embodiment, the charge removing device 20 including a tungsten lamp will be described with reference to FIG. 5. It is to be understood that this is only an example and does not limit the present invention.

Figure 5:
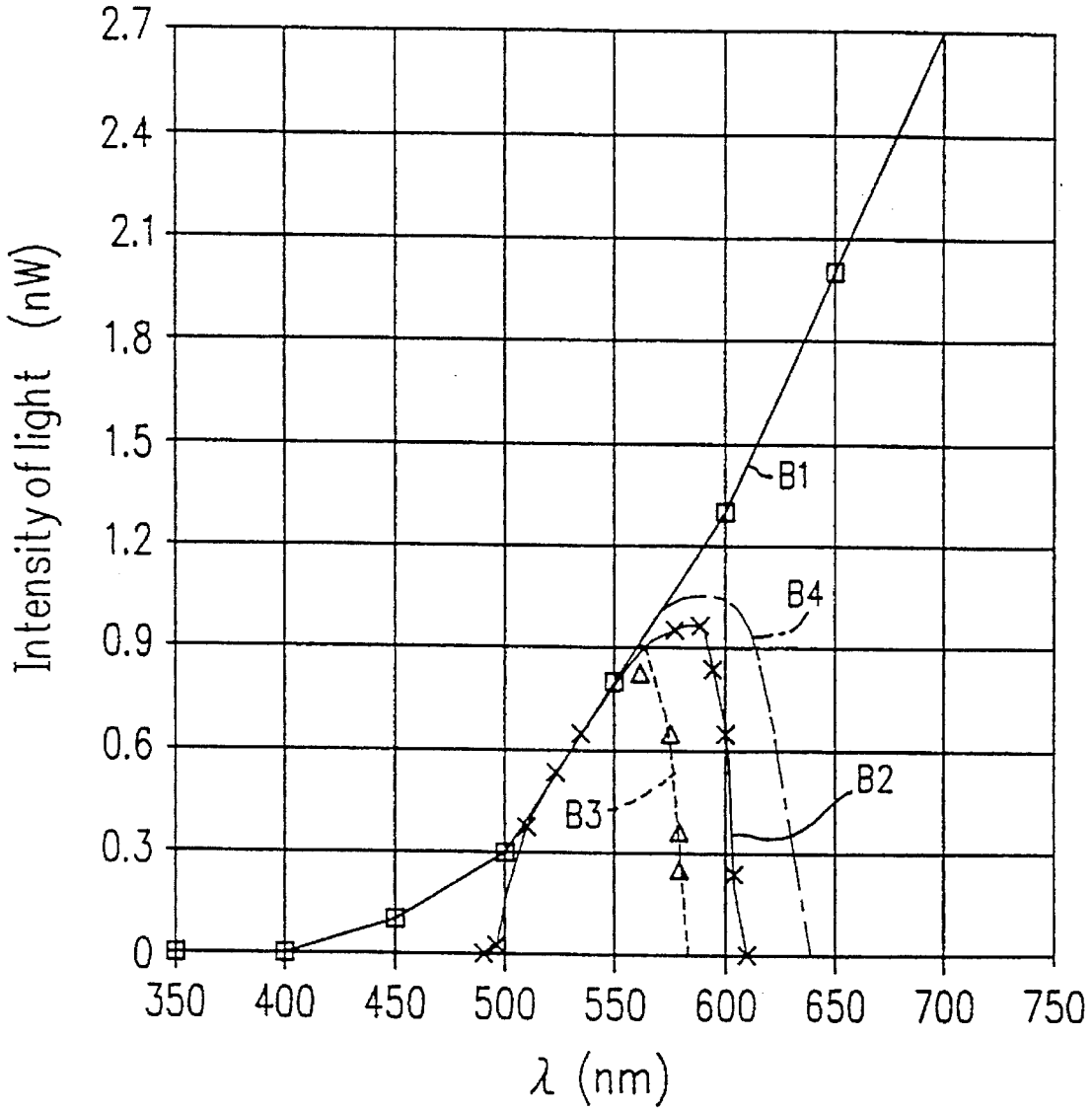
FIG. 5 is a graph illustrating the relationship between the optical intensity and the wavelength of light emitted by different optical sources using a tungsten lamp.
Figure 6:
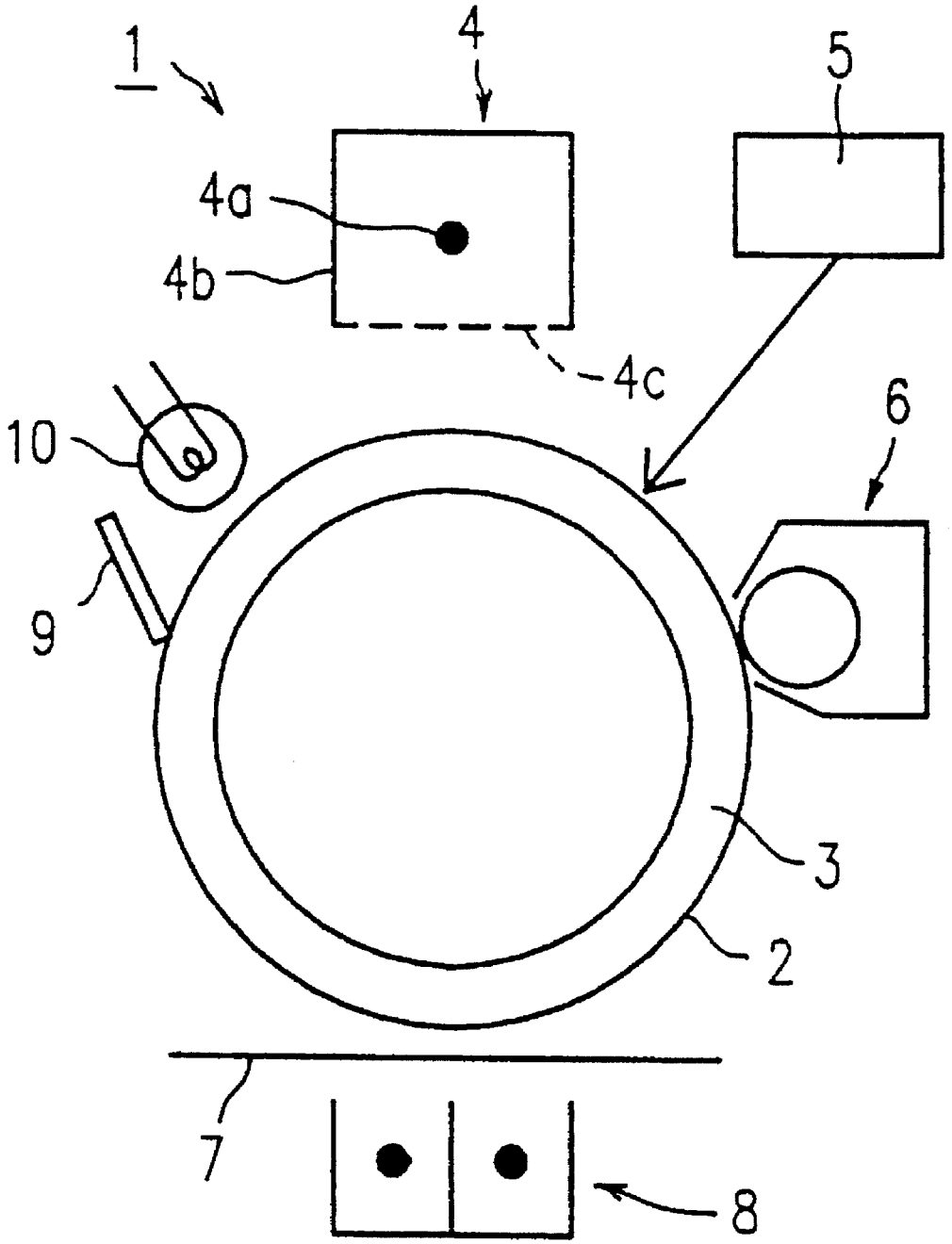
FIG. 6 is a schematic view of a conventional image forming apparatus.
Figure 7:
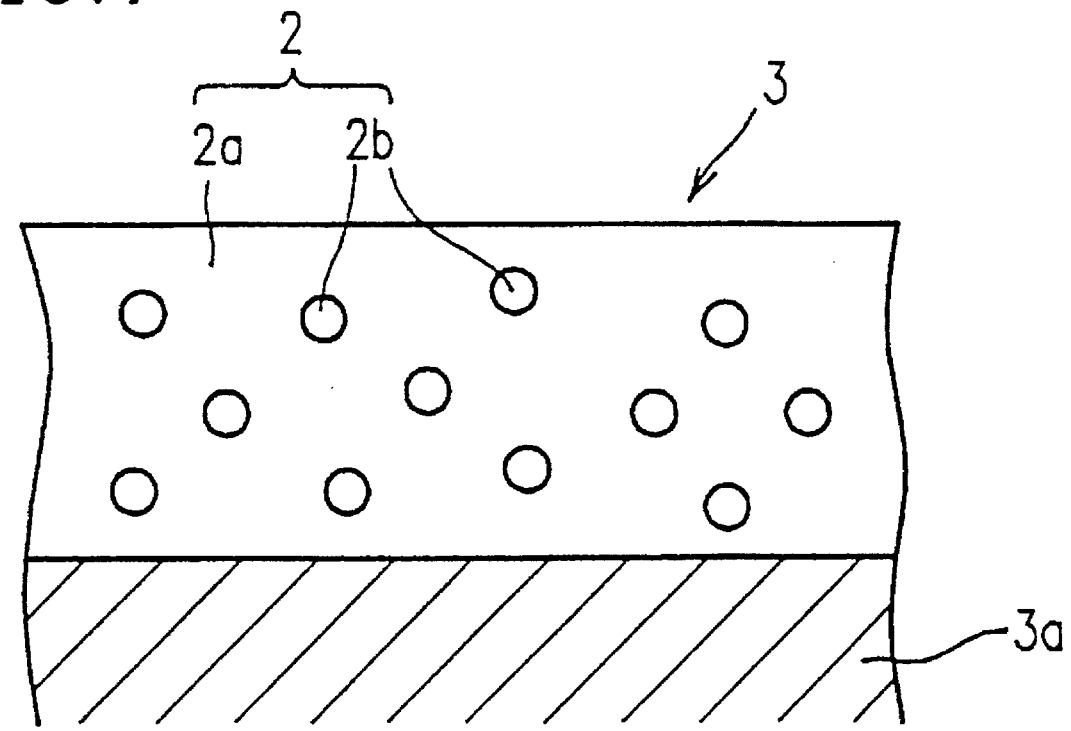
FIG. 7 is an enlarged cross sectional view of a photosensitive drum of the image forming apparatus.
Figure 8:
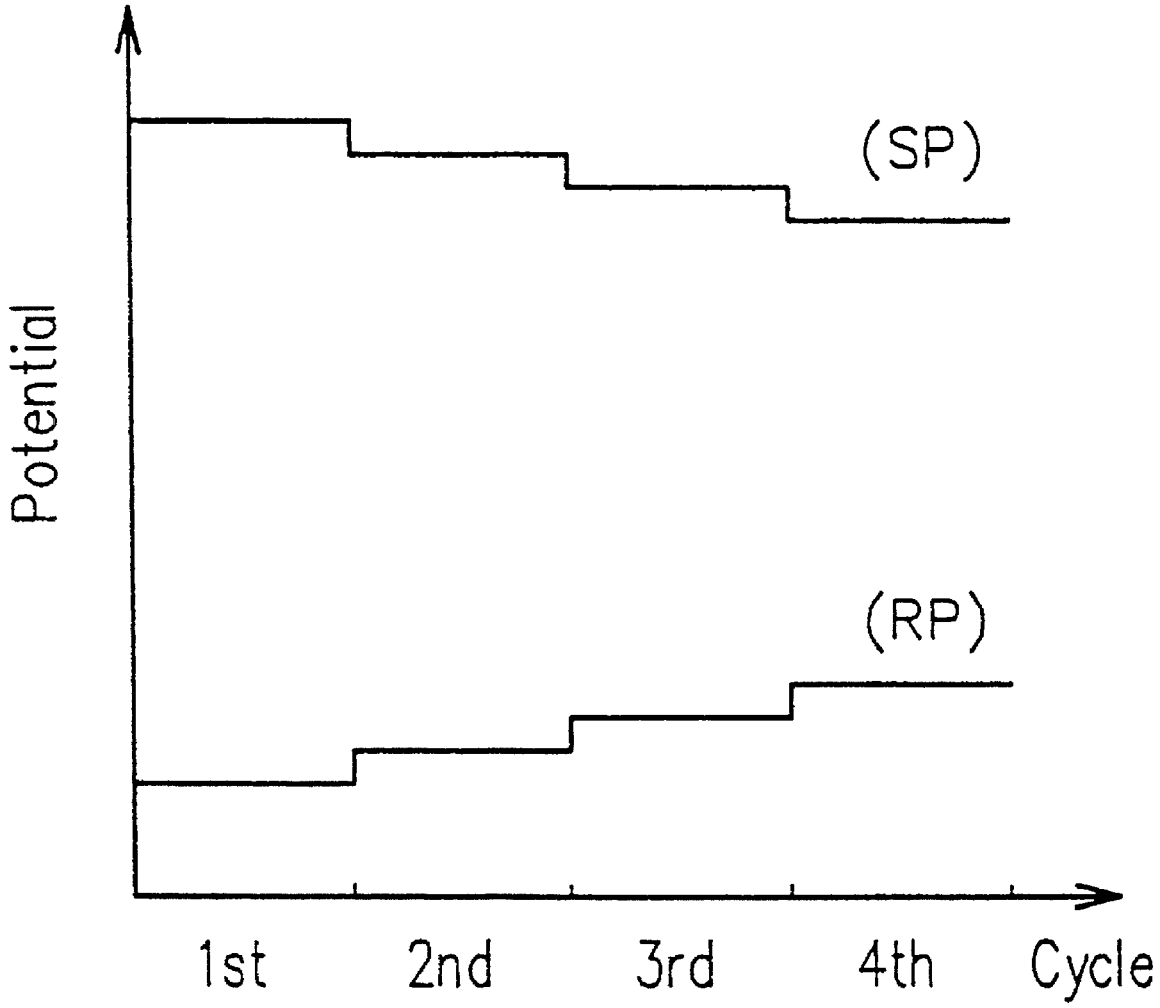
FIG. 8 is a graph illustrating the relationship between the potential of a photosensitive drum of the conventional image forming apparatus shown in FIG. 6 and the number of rotations of the photosensitive drum.

FIG. 5 is a graph illustrating the spectral distribution, namely, the intensity of the light in accordance with the wavelength of the light. Line B1 represents the spectral distribution obtained when only a tungsten lamp is used. The wavelength is distributed in the entire wavelength range of the light emitted by the tungsten lamp. Line B2 represents the spectral distribution obtained when a tungsten lamp is used in combination with a filter which allows light having a wavelength between 520 nm and 600 nm to transmit therethrough. Line B3 represents the spectral distribution obtained when a tungsten lamp is used in combination with a filter which allows light having a wavelength between 510 nm and 580 nm to transmit therethrough. Line B4 represents the spectral distribution obtained when a tungsten lamp is used in combination with a filter which allows light having a wavelength between 530 nm and 625 nm to transmit therethrough.

Thus, light having a wavelength in a preferable range can be emitted by using a tungsten lamp in combination with a filter as the charge removing device 20.

In the case that the photosensitive film 12 having the light absorbance characteristic shown in FIG. 2 is used, light having a wavelength in the range between 490 nm and 583 nm which corresponds to half of the maximum absorbance of the photosensitive film 12 is selected. Accordingly, by using the tungsten lamp and the filter corresponding to line B3 (510 nm to 580 nm), the light having a wavelength in the range suitable for the photosensitive film 12 represented by FIG. 2 can be selected.

In addition to the charge removing device 20, other charge removing members for emitting light having a wavelength in the above-described range may be provided. One of such charge removing members may be a blank lamp 26 located between the main charger 14 and the developing device 16 for emitting light to a part of the photosensitive film 12 to perform masking, trimming, or other processing. Another of such charge removing members may be a pre-transference removing device 27 located between the developing device 16 and the transfer device 18 for removing the charge on the photosensitive film 12 before transference. Still another of such charge removing members may be a pre-cleaning removing device 28 located between the transfer device 18 and the cleaning device 19 for removing the charge on the photosensitive film 12 before cleaning is performed by the cleaning device 19.

The charge removing members 20, 26, 27 and 28 all radiate light having a wavelength in the above-selected range to the photosensitive film 12. Since the radiated light is properly absorbed into the photosensitive film 12 and thus is prevented from reaching a bottom part of the photosensitive film 12, generation of carriers at the bottom part of the photosensitive film 12 by the light emitted by any of the charge removing members is avoided. Accordingly, the carriers are prevented from remaining in the photosensitive film 12 when the photosensitive film 12 is charged by the main charger 14 after the photosensitive film 12 is exposed to light by any of the charge removing members.

By removing the charge on the photosensitive film 12 prior to the charging of the photosensitive film 12, the surface potential of the photosensitive film 12 after removal of the charge is kept at, for example, 100 V or less. In order to realize such a level of the surface potential, the charge removing device 20 preferably emits light of 5 lux·sec or more, preferably 10 lux·sec or more. If the charge removing device 20 emits light of 200 lux·sec or more, the photosensitive film 12 wears out, and thus the image quality possibly deteriorates.

Main Charger

As the main charger 14, a corona contact charger, for example, is used. As the corona contact charger, a Scorotron charger is preferably used due to the low power consumption thereof. The Scorotron charger charges the photosensitive film 12 up to a prescribed upper limit. Conventionally, when the surface potential of the photosensitive film 12 is reduced by the carriers generated by light radiation by a charge removing member, the main charger 14 performs discharge in order to compensate for the reduction. However, according to the present invention, carriers are not generated by light radiation by any charge removing member.

Returning to FIG. 1, the main charger 14 includes a discharge wire 21 for performing corona discharge, a shielding case 22 surrounding the discharge wire 21 and having an opening opposed to the photosensitive drum 13, and a metal grid 23 located at the opening of the shielding case 22. The discharge wire 21 is connected to a power source 25 for supplying the discharge wire 21 with a necessary amount of current for the corona discharge. The shielding case 22 is grounded.

A current Icc from the power source 25 flowing to the discharge wire 21 is branched into a discharge current Isc flowing to the shielding case 22, a discharge current Igc flowing to the grid 23, and a discharge current Ipc flowing to the photosensitive drum 13. In order to allow the discharge current from the discharge wire 21 to reach the surface of the photosensitive film 12 through the grid 23, the surface potential of photosensitive film 12 should be lower than the potential of the grid 23.

When the discharge current Ipc is supplied to the charging position of the photosensitive film 12 by the discharge performed by the discharge wire 21, the surface potential of the charging position of the photosensitive film 12 gradually rises. When the surface potential becomes substantially equal to the potential of the grid 23, no discharge occurs thereafter between the grid 23 and the photosensitive film 12. Thereafter, the current Icc supplied to the discharge wire 21 is only branched into the discharge currents Isc or Igc. Accordingly, the surface potential of the photosensitive film 12 is determined by the potential of the grid 23 and is maintained in the vicinity of the potential of the grid 23 after reaching the potential of the grid 23.

Generally, it is preferable to charge the photosensitive film 12 by the main charger 14 so that the saturation potential Vs is in the range between 500 V and 1,000 V, preferably in the range between 700 V and 850 V. In order to perform such charging, it is preferable to apply a high voltage of 4 to 7 kV to the discharge wire 21 of the main charger 14 when performing corona discharge.

Optical Device, Developing Device and Transfer Device

As the optical device 15 used in the image forming apparatus 11, an optical system including a lens, a reflecting mirror and the like, a laser oscillator, or the like may be used.

The developing device 16 is provided with a developing roller for supplying the surface of the photosensitive film 12 with a mono-component or a two-component toner which is charged.

As the transfer device 18, a corona charger similar to the one used as the main charger 14 or a contact charger may be used.

Photosensitive Film

In the image forming apparatus 11 according to the present invention, the photosensitive film 12 has preferably a light absorbance characteristic having a clear, single peak.

In an image forming apparatus including a single-layer organic photosensitive film to be positively charged in one embodiment according to the present invention, the photosensitive film 12 may be formed by dispersing a charge generating material in a charge carrying medium.

Any charge generating material which is generally used by those of ordinary skill in the art may be used. Especially, an organic photoconductive type pigment is preferable. For example, a phthalocyanine-type pigment, a perylene-type pigment, a quinacridone-type pigment, a pyranetron-type pigment, a bisazo-type pigment, or a trisazo-type pigment may be used. Such photoconductive pigments may be used independently or in a combination of two or more.

The charge carrier medium may be formed by dispersing a charge carrying material in a binder resin.

As the charge carrying material, a hole carrying material or an electron carrying material which is generally used by those of ordinary skill in the art may be used.

As the hole carrying material, a phenylenediamine-type compound, for example, N,N,N',N'-tetrakis(3-methylphenyl)-m-phenylenediamine, poly-N-vinylcarbazole, phenanthrene, N-ethylcarbazole, 2,5-diphenyl-1,3,4-oxadiazole, 2,5-bis(4-diethylaminophenyl)-1,3,4-oxadiazole, bis-diethylaminophenyl-1,3,6-oxadiazole, 4,4'-bis(diethylamino)-2,2'-dimethyltriphenylmethane, 2,4,5-triaminophenylimidazole, 2,5-bis(4-diethylaminophenyl)- 1,3,4-triazole, 1-phenyl-3-(4-diethylaminostyril)-5-(4-diethylaminophenyl)-2-pyrazoline, or p-diethylaminobenzaldehyde-(diphenylhydrazone) may be used. Such compounds may be used independently or in a combination of two or more.

As the electron carrying material, phenoquinone, for example, 3,5,3',5'-tetraphenyldiphenoquinone, 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxantone, dinitroanthracene, dinitroacridine, or dinitroantoquinone may be used. Such materials may be used independently or in a combination of two or more.

As the binder resin, for example, a styrene-type polymer, a styrene-butadiene copolymer, a styrene-acrylonitrile copolymer, a styrene-maleic acid copolymer, an acryl-type polymer, a styrene-acryl copolymer, a styrene-vinyl acetate copolymer, a poly(vinyl chloride), a vinyl chloride-vinyl acetate copolymer, polyester, an alkyd resin, polyamide, polyurethane, an epoxy resin, polycarbonate, polyallylate, polysulfone, a diallylphthalate resin, a silicone resin, a ketone resin, a polyvinylbutylale resin, a polyether resin, a phenol resin; a photocurable resin such as epoxy acrylate or urethane acrylate; or other copolymers may be used. A photoconductive polymer such as poly-N-vinylcarbazole may also be used.

The amount of the charge generation material contained in the photosensitive film 12 is preferably 0.1 to 50 parts, more preferably 0.5 to 30 parts with respect to 100 parts of the binder resin. The amount of the charge carrying material contained in the photosensitive film 12 is preferably 20 to 500 parts, more preferably 30 to 200 parts with respect to 100 parts of the binder resin. The photosensitive film 12 preferably has a thickness of 10 to 40 μm, more preferably 22 to 32 μm to obtain a high surface potential, a high durability against image forming, and high sensitivity.

The drum substrate 30, which comprises a photosensitive drum 13, may be formed of any conductive material. The substrate may be used in any form such as a sheet, or a cylinder. Either the drum substrate 30 itself or the surface thereof may be conductive. The drum substrate 30 preferably has a sufficient mechanical strength for use. In general, the drum substrate 30 is formed of a plain aluminum tube or an aluminum tube with an alumetized surface. The drum substrate 30 may also be formed of a conductive resin, a conductive film or the like.

The photosensitive film 12 is formed in the following manner.

The binder resin is dissolved in a solvent, and the charge generating material and, if necessary, the charge carrying material are dispersed in the dissolved binder resin to prepare a composition. The composition is applied to the drum substrate 30 and dried to form the photosensitive film 12. As the solvent, for example, an amide-type solvent such as N,N-dimethylformamide or N,N-dimethylacetoamide; a cyclic ether such as tetrahydrofuran or dioxan; dimethylsulfoxide; an aromatic solvent such as benzene, toluene, or xylene; ketone such as methylethylketone; N-methyl-2-pyrrolidone; or phenols such as phenol or cresol may be used.

The present invention has a remarkable advantage when a single-layer organic photosensitive body to be positively charged is used. A photosensitive body to be positively charged is advantageous in generating very little ozone when charged. In the case that the photosensitive body to be positively charged is used, a perylene-type pigment, an azo-type pigment or a combination of the two is preferably used as the charge generating material. As the charge carrying material, a diphenoquinone derivative such as 2,6-dimethyl-2',6-ditert-butyldiphenoquinone, a diamine-type compound such as 3,3'-dimethyl-N,N,N',N'-tetrakis-4-methylphenyl(1,1'-biphenyl)- 4,4'-diamine, a fluorene-type compound, or a hydrazone-type compound is preferably used.

In the above embodiment, the photosensitive film is formed on a drum-like substrate. The photosensitive film may also be formed on a belt-like substrate.

In the above embodiment, an electrostatic copier is used as the image forming apparatus. The present invention is applicable to any image forming apparatus for forming an image using an electrophotographic technology.

<EXAMPLE>

Preparation of the Photosensitive Film 12

Materials having the following compositions were mixed by a ball mill for 50 hours and dispersed to prepare a photosensitive liquid used for a single-layer organic photosentitive film 12.

| | |
|---|---|
| Bisazo pigment represented by formula I | 10 parts |
| Polycarbonate resin (binder resin) | 100 parts |
| N,N,N',N'-tetrakis (3-methylphenyl)-m-phenylenedi-amine (hole carrying material) | 100 parts |
| 3,5,3',5'-tetraphenyldiphenoquinone (electron carrying material) | 50 parts |
| and | |
| dichloromethane | 800 parts |

-continued

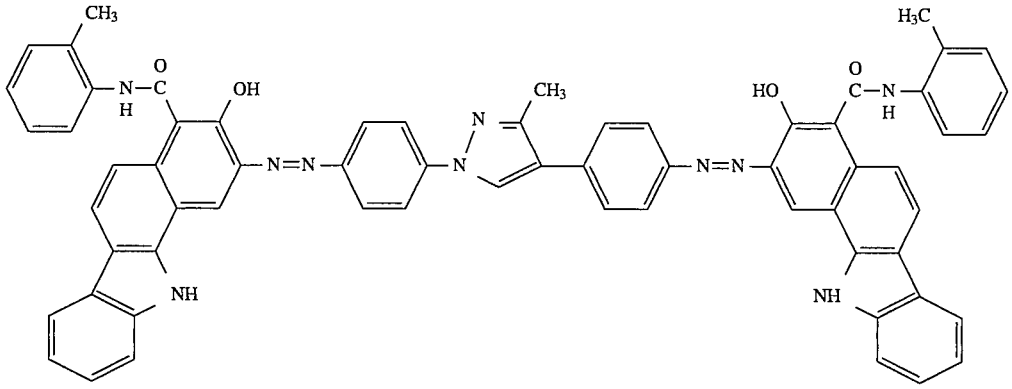

Formula I

The photosensitive liquid was applied to an OHP film in a thickness of 30 μm by a wire bar, and the OHP film was heated to form the photosensitive film 12.

Measurement of the Light Absorbance Characteristic of the Photosensitive Film and Determination of the Wavelength Range The light absorbance of the photosensitive film 12 was measured using a visible light-UV spectrometer U-3210 produced by Hitachi Co., Ltd. The photosensitive film 12 had the light absorbance characteristic illustrated in FIG. 2. Namely, the wavelength of the light having the maximum absorbance is 550 nm, and the absolute value of the maximum absorbance is 1.6. The light having a light absorbance which is half of the maximum absorbance, 0.8, has wavelengths of 490 nm and 583 nm. Accordingly, the light having a wavelength in the range between 490 nm and 583 nm should be selected.

Evaluation of the Image Forming Apparatus

The photosensitive liquid prepared in the above-described manner was applied to a conductive aluminum cylinder having an outer diameter of 78 mm by immersion. Next, the aluminum cylinder was dried by hot air of 100° C. for 60 minutes to form a single-layer photosensitive layer having a thickness of 25 μm. In this manner, the photosensitive drum 13 having the photosensitive film 12 to be positively charged was formed, and the image forming apparatus 11 having the photosensitive drum 13 was produced.

Figure 3:
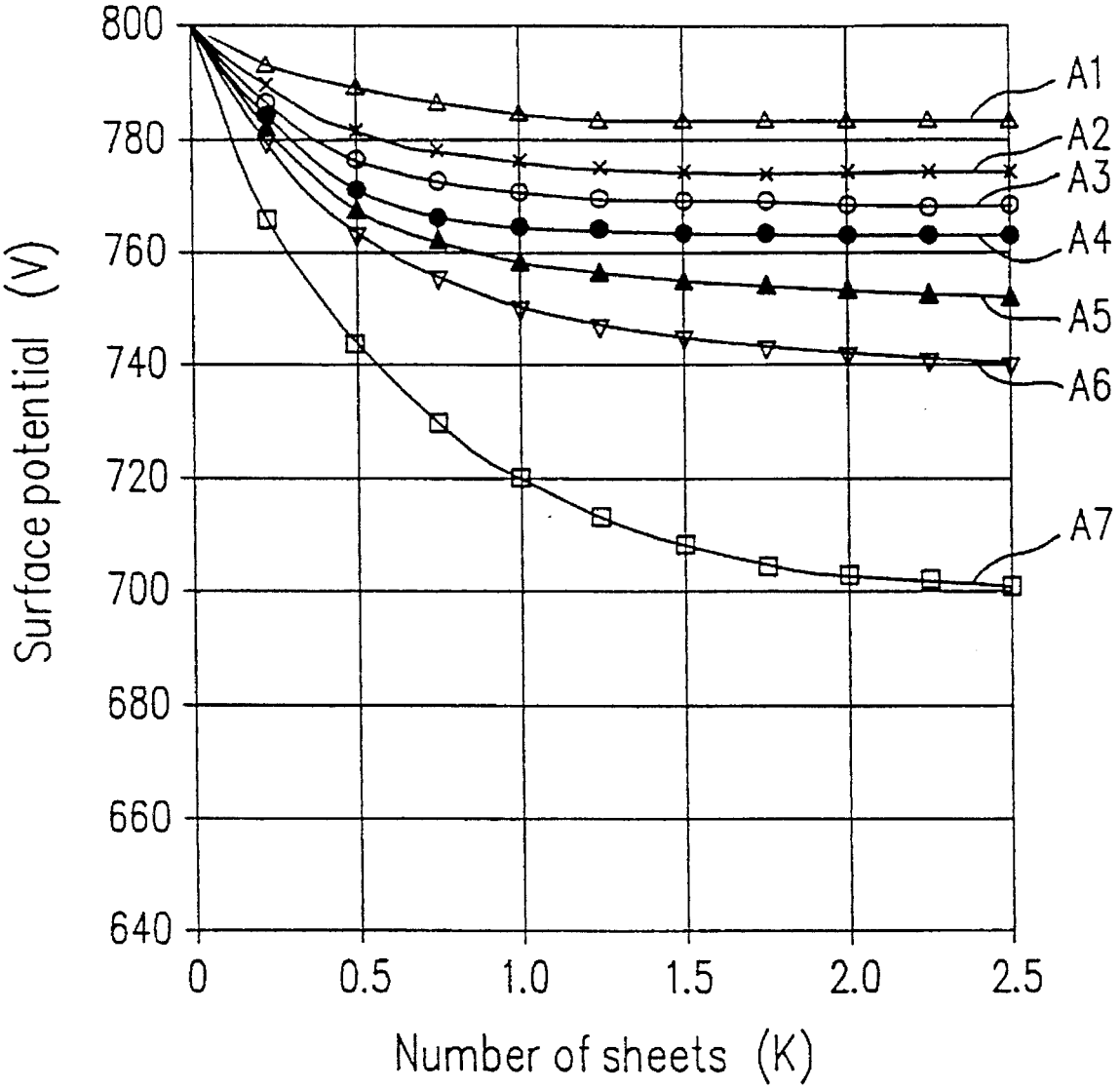
FIG. 3 is a graph illustrating the relationship between the surface potential of the photosensitive film and the number of sheets of paper on which an image can be formed in accordance with different types of optical sources.

FIG. 3 is a graph illustrating the relationship between the surface potential of the photosensitive film 12 and the number of sheets of paper on which an image can be formed in accordance with different wavelengths of the light emitted by the charge removing device 20.

The surface potential of the photosensitive film 12 was measured in the following manner.

The dark surface potential of the photosensitive film 12 was set for 800 V, and the intensity of light was set so that the potential after removal of the charge would be 80 V. After images were formed on 2,500 A3 paper sheets (conforming to Japan Industrial Standards) using the photosensitive drum 13 having a diameter of 78 mm at the circumferential rate of 250 mm/sec, the surface potential of the photosensitive film 12 was measured.

In FIG. 3, lines A1 through A6 show the results obtained by light according to the present invention, and line A7 shows the results obtained by light as a comparative example. Line A1 represents the above-described relationship obtained when a cold CRT and a filter were used for radiating light having a wavelength of 550 nm. Line A2 represents the above-described relationship obtained when a green LED used for radiating light having a maximum wavelength of 565 nm. Line A3 represents the above-described relationship obtained when a tungsten lamp and a filter were used for radiating light having a maximum wavelength of 560 nm. Line A4 represents the above-described relationship obtained when a tungsten lamp and a filter were used for radiating light having a maximum wavelength of 580 nm. Line A5 represents the above-described relationship obtained when a tungsten lamp and a filter were used for radiating light having a maximum wavelength of 590 nm. Line A6 represents the above-described relationship obtained when a tungsten lamp and a filter were used for radiating light having a maximum wavelength of 600 nm. Line A7 represents the above-described relationship obtained when a red LED for emitting light having wavelength of 660 nm was used.

Although the maximum wavelength of light corresponding to lines A5 and A6 are outside the above-selected range, light having a wavelength of 583 nm or less is also emitted. It is considered that a satisfactory charge removing effect was achieved by the light within the above-selected range.

The light source represented by line A7 did not emit light having a wavelength in the above-selected range.

Figure 4:
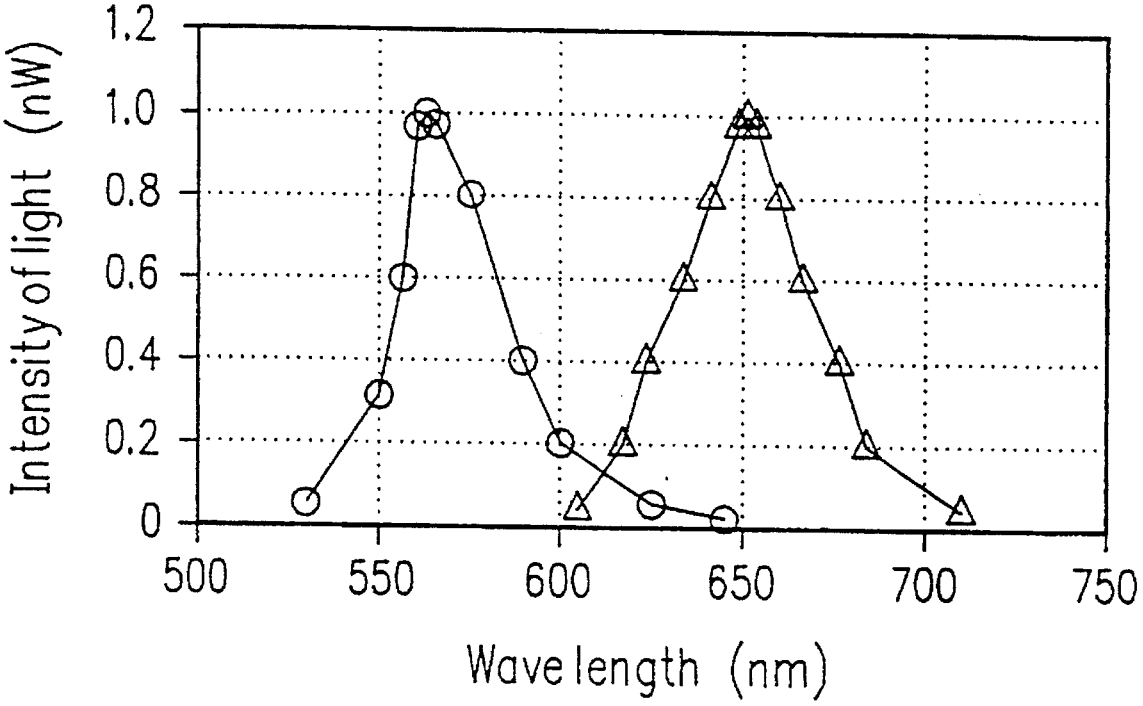
FIG. 4 is a graph illustrating spectral distributions of light emitted by green and red LEDs.

FIG. 4 is a graph illustrating the wavelength range of the light emitted by green and red LEDs.

The wavelength range of light emitted by the green LED is close to the wavelength of light having the maximum absorbance of the photosensitive film 12 (FIG. 2). It is understood from FIG. 3 that a light source for emitting light having a wavelength in such a range is preferable.

Accordingly, in the case that an LED is used in this example, an LED for green light (for example, SLR-54MC produced by ROHM Ltd.) is preferable.

Reduction in the surface potential from the initial level of 800 V is preferably 60 V or less after copying 2500 sheets of paper as is shown by lines A1 through A6 in FIG. 3. An LED for red light (SLS-54VC produced by ROHM Ltd.) reduces the surface potential of the photosensitive film 12 significantly as is represented by line A7 in FIG. 3, and thus is not suitable.

As has been described so far, according to the present invention, light having a wavelength within a range suitable to a material of the photosensitive film is radiated to the photosensitive film by the charge removing member. Therefore, generation of carriers in the photosensitive film is prevented, and thus significantly improves the image quality. Furthermore, because of the use of light of a specific wavelength, residual charge on the photosensitive film is eliminated before the photosensitive film is charged by the main charger. As a result, reduction in the surface potential can be avoided, and thus charging ability and the charge retaining ability of the photosensitive film are enhanced. Therefore, the image quality is remarkably improved. Since the use of such light also restricts generation of a heat wave, the cooling member of the image forming apparatus is simplified. Due to the restriction of the heat wave, the photosensitive film is prevented from wearing due to light and thus has stable characteristics. Furthermore, since the surface potential of the photosensitive film is maintained sufficiently well by the use of light suitable to the photosensitive film, a stable aging characteristic is obtained.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image forming apparatus, comprising:

a rotatable photosensitive member including a conductive substrate and a photosensitive film located on a surface of the substrate;

charging means located in the vicinity of the photosensitive member for charging the photosensitive film;

exposure means for radiating light corresponding to an image to the photosensitive film which is charged;

developing means located downstream with respect to the exposure means in a rotation direction of the photosensitive member for developing the image on the photosensitive film;

transfer means located downstream with respect to the developing means in the rotation direction of the photosensitive member for transferring the image developed on the photosensitive film onto an image receiving member;

cleaning means located downstream with respect to the transfer means in the rotation direction of the photosensitive member for cleaning the photosensitive film after the transference; and charge removing means including an optical source located opposed to the photosensitive member for radiating light to the photosensitive film, wherein the wavelength of light emitted by the optical source is selected from the range between wavelengths which correspond to half of a maximum absorbance in a light absorbance characteristic of the photosensitive film and a charge generating material included in the photosensitive film.

2. An image forming apparatus, according to claim 1, wherein the charge removing means includes at least one of:

a charge removing lamp located upstream with respect to the charging means in the rotation direction of the photosensitive member and in the vicinity of the cleaning means for radiating light to the photosensitive film prior to charging performed by the charging means to remove residual carriers on the photosensitive film;

a blank lamp located between the charging means and the developing means for radiating light to a part of the photosensitive film;

a pre-transference charge removing device located between the developing means and the transfer means for removing the charge of the photosensitive film prior to the transference; and a pre-cleaning charge removing device located between the transfer means and the cleaning means for removing the charge of the photosensitive film prior to the cleaning.

3. An image forming apparatus according to claim 1, wherein the light emitted by the optical source is single color light.

4. An image forming apparatus according to claim 1, wherein the photosensitive film is a single-layer organic photosensitive film to be positively charged.

* * * * *